US006079817A

United States Patent [19]

Shima et al.

[11] Patent Number: 6,079,817

[45] Date of Patent: Jun. 27, 2000

[54] ELECTROSTATIC INK-JET RECORDING HEAD

[75] Inventors: Kazuo Shima; Junichi Suetsugu; Tadashi Mizoguchi; Hitoshi Minemoto; Tomoya Saeki; Hitoshi Takemoto; Yoshihiro Hagiwara; Toru Yakushiji, all of Niigata, Japan

[73] Assignee: NEC Corporation, Tokyo, Japan

[21] Appl. No.: 09/049,125

[22] Filed: Mar. 27, 1998

[30] Foreign Application Priority Data

Apr. 4, 1997 [JP] Japan ..... 9-086229

[51] Int. Cl.[7] ..... B41J 2/06

[52] U.S. Cl. ..... 347/55

[58] Field of Search ..... 347/20, 44, 45, 347/54, 55, 63, 66, 112, 141

[56] References Cited

U.S. PATENT DOCUMENTS

| | | | |
|---|---|---|---|
| 4,751,531 | 6/1988 | Saito et al. | 347/55 |
| 4,751,532 | 6/1988 | Fujimura et al. | 347/55 |
| 5,576,747 | 11/1996 | Sohn . | |
| 5,748,212 | 5/1998 | Takagi | 347/55 |
| 5,754,199 | 5/1998 | Miki et al. | 347/55 |
| 5,754,200 | 5/1998 | Minemoto et al. | 347/55 |
| 5,801,730 | 9/1998 | Shima et al. | 347/55 |

FOREIGN PATENT DOCUMENTS

| | | |
|---|---|---|
| 0 703 081 | 3/1996 | European Pat. Off. . |
| 0 761 444 | 3/1997 | European Pat. Off. . |
| 0 764 529 | 3/1997 | European Pat. Off. . |
| 09001824 | 1/1997 | Japan . |
| WO 93/11866 | 6/1993 | WIPO . |
| WO 97/27058 | 7/1997 | WIPO . |

OTHER PUBLICATIONS

European Search Report Dated Jul. 29, 1999.

*Primary Examiner*—Sandra Brase
*Attorney, Agent, or Firm*—McGinn & Gibb, P.C.

[57] ABSTRACT

The electrostatic ink-jet recording head according to the present invention comprises: recording electrodes which eject ink towards the recording paper; an opposing electrode for generating a prescribed electric field between the recording electrodes and the opposing electrode; and ink discharge end sections formed in the vicinity of the recording electrodes. The ink discharge end sections are formed closer to the opposing electrode than the end portions of the recording electrodes.

In this case, the equipotential lines in the region of the ink discharge end sections when a recording voltage is applied are virtually perpendicular to the direction in which the ink is discharged. This is because, the recording electrodes are positioned slightly behind the ink discharge end sections in the ink discharge member. In this case, an electrostatic force acts on the toner particles near the ink discharge end sections in the direction of the ink discharge end sections. Therefore, even when a recording voltage is applied, there is a continuous supply of toner particles to the ink discharge end sections.

As described above, in the electrostatic ink-jet recording head according to the present embodiment, a convex ink meniscus is formed in front of the recording electrodes. Therefore, toner particles gather at the discharge points, even when a recording voltage is applied, and thus a sufficient quantity of toner particles for forming a desired dot size can be supplied.

30 Claims, 6 Drawing Sheets

ELECTROSTATIC INK-JET RECORDING HEAD

BACKGROUND OF THE INVENTION

1. Field of the Invention

The present invention relates to a printer which performs a recording operation by applying toner to a recording medium, such as printing paper, and more particularly, to an electrostatic ink-jet recording head used in an electrostatic ink-jet printer.

2. Description of the Related Art

Conventionally, printer recording technology based on non-impact systems has the advantage that the generation of noise during recording etc. is so small as to be negligible. Ink-jet recording systems, in particular, allow printing and recording at high speed directly onto a recording medium, using a simple construction. Furthermore, they also allow recording onto normal paper, and therefore represent extremely advantageous recording systems. For example, FIGS. 4–7 illustrate a conventional example of a recording head proposed as an ink-jet recording system. This conventional example uses an ink containing toner particles dispersed in a carrier liquid for printing onto recording paper 8. In addition to needle-shaped recording electrodes 3 provided on the recording head side, an opposing electrode 7 is also provided at the rear side of the recording paper in a position opposing the recording electrodes 3. In this system, an electric field is generated by applying a voltage to the recording electrodes 3 and the opposing electrode 7, and the toner particles in the ink are ejected towards the recording paper 8 by means of the electrostatic force created by the electric field.

As shown in FIG. 4, the ink-jet recording head comprises a substrate 1 made from an insulating material of plastic, or the like, and a base film 2 covering this substrate 1. The base film 2 is made from an insulating material, such as polyimide, and has a thickness of approximately 50 $\mu$m. A plurality of recording electrodes 3 are patterned on the surface of this base film 2. The recording electrodes 3 are formed by plating a conductive material of copper (Cu), or the like, onto the surface of the base film 2 to a thickness of 20–30 $\mu$m, and then patterning such that the interval between adjacent electrodes is 300 dpi pitch, namely, about 85 $\mu$m.

The end portion of each recording electrode 3 projects externally (towards the opposing electrode) from one edge of the base film 2 by 80–500 $\mu$m. The surface of the recording electrodes 3 is covered uniformly by a film of insulating coating material 4 to a thickness of 10 $\mu$m or less, as shown in FIG. 5 and FIG. 6, which are enlargements of the portion indicated by arrow A in FIG. 4.

Furthermore, in the ink-jet recording head, a portion of the upper surface of the base film 2 is covered by a cover 5. The cover 5 is formed from an insulating material and is shaped such that it does not interfere with the projecting end portions of the recording electrodes 3. An ink supply inlet 5*a* and an ink drain outlet (not illustrated) are provided, respectively.

The space enclosed by the base film 2 and the cover 5 forms an ink chamber, and ink is introduced via the ink supply inlet 5*a* such that the ink 6 is always in a full state inside the chamber. A slit-shaped ink spray outlet 5*b* is formed at the edge of the cover 5, between the cover 5 and the base film 2. The aforementioned end portions of the recording electrodes 3 project through this ink spray outlet 5*b*. Thereby, an ink meniscus indicated by symbol 6*a* is formed at this slit-shaped ink spray outlet 5*b*.

A constant back-pressure is applied to the ink 6 in the ink chamber. Therefore, due to the surface tension and capillary action of the ink itself, the ink 6 forms an ink meniscus 6*b* having a concave shape at the ink spray outlet 5*b*. Since the end portions of the recording electrodes 3 project from the base film 2 and the cover 5, when viewed from above as in FIG. 5, the ink meniscus 6*a* forms a U-shape between adjacent recording electrodes 3. Furthermore, as shown in FIG. 6, when viewed from the side, the ink meniscus 6*a* has a downward concave shape.

Therefore, when a high-voltage pulse is supplied to one of the recording electrodes, the electric field concentrates on the end region of the ink meniscus 6*a* at the projecting end portion of that electrode. Induced by this electric field, the charged toner in the ink is expelled from the end region of the ink meniscus 6*a*. This forms an ink drop 6*b*, as shown in FIG. 5, which is ejected towards the recording paper 8 on the side of the opposing electrode 7 positioned opposite the recording head, and is thereby printed onto the recording paper 8.

FIG. 7 shows an approximate diagram of equipotential lines showing the potential generated between the recording electrodes 3 and the opposing electrode 40 during recording in a conventional ink-jet recording head.

When a voltage is supplied to a recording electrode 3, the equipotential lines in the vicinity of the projecting point 3*a* at the end of that recording electrode 3 assume a semi-elliptical shape surrounding the recording electrode 3, whose end portion is projecting from the ink spray outlet 5*b*. Furthermore, in PCT international publication (International Publication Number WO 93/11866), an invention is disclosed wherein conductive members projects towards an opposing electrode, and prescribed particles are caused to fly out from the ends of the conductive members by an electric field generated between these conductive members and the opposing electrode.

However, in the conventional ink-jet recording heads described above, there have the following kinds of problems. A first problem is that it is difficult to form the ink into a desired dot size when recording onto recording paper. This is because a high-voltage pulse is supplied to the recording electrode 3 as a recording voltage, and the end portion of the recording electrode 3 itself forms a discharge point 3*a* for the ink 6. In this process, there is insufficient electrostatic force acting on the toner particles near the discharge point 3*a* in the direction of the discharge point 3*a*.

In other words, as shown in FIG. 7, in the region surrounding the recording electrode 3, the equipotential lines 9 are virtually parallel to the direction of ink discharge, with the exception of the region in front of the discharge point 3*a* (opposing electrode side). Therefore, insufficient electrostatic force is generated in the direction of the discharge point 3*a* with respect to toner particles in the vicinity of the discharge point 3*a*. Since the electrostatic force acting on the toner particles is weak, the amount of toner particles supplied to the discharge point 3*a* is insufficient for forming the desired dot size.

A second problem is that the discharge of ink droplets becomes unstable. This is because the ink meniscus 6*a* connects continuously across the recording electrodes 3, having vertices at the discharge points 3*a*, and therefore, the liquid surface in the vicinity of a discharge point 3*a* which has discharged ink will vibrate and affect the ink meniscus 6*a*, thus making it impossible to obtain an ink meniscus 6*a* that is stable at all times. A third problem is the occurrence of ink droplet discharge faults due to excessive concentration of toner particles in the ink spray outlet 5*b*. The reason for this is that the ink spray outlet 5*b* in the cover which supplies ink 6 to the discharge points 3*a* for discharge, is formed in a portion of the ink chamber in the shape of a slit of a size which prevents overflowing of ink. Consequently, no flow of ink 6 is produced at the ink spray outlet 5*b*, and there is an excessive concentration of toner particles in this region, causing the ink viscosity to rise above the required level.

SUMMARY OF THE INVENTION

It is an object of the present invention to provide an electrostatic ink-jet recording head, whereby ink droplets can be formed to a desired dot size by supplying an appropriate quantity of toner particles, preventing excessive concentration of these toner particles in the ink discharge section, and stabilizing ink discharge.

The electrostatic ink-jet recording head according to the present invention comprises a plurality of recording electrodes patterned onto a substrate supported on a head block. A pulse voltage is supplied to a desired recording electrode to create an electric field between it and an opposing electrode, thereby generating an electrostatic force which causes charged toner particles contained in the ink to be discharged from a discharge point and printed onto recording paper.

The recording head comprises an ink discharge member supported on the head block, and this ink discharge member is connected to an ink supply chamber and ink drain chamber provided in the head block. Meanwhile, the recording head also comprises a plurality of ink recycling grooves formed in correspondence to the recording electrodes, and the end sections of these ink recycling grooves form ink discharge end sections. The ink discharge end sections project forward beyond the edges of the recording electrodes in the direction of the opposing electrode. Ink is ejected from these ink discharge end sections.

The ink discharge end sections have two oblique faces which are mutually orthogonal, and they are positioned against the substrate such that the recording electrodes confront the ink recycling grooves formed on one of the faces. Furthermore, a plate-shaped covering member is positioned against the ink discharge grooves formed in the other face, and the ink discharge end sections are exposed externally from this region enclosed by the covering member and the substrate in the direction of the opposing electrode.

The recording electrodes have a greater width than that of the ink discharge end sections, and they are provided at a pitch of one per ink discharge end section. The longitudinal axis of the recording electrodes matches the longitudinal axis of the ink discharge end section at which they are provided.

Moreover, the surface of the recording electrodes is covered by a film of insulating coating material, and the ink discharge member can be made from an insulating material having a dielectric constant of 10 or less. Furthermore, a migration electrode in contact with the ink may be positioned inside the ink supply chamber.

BRIEF DESCRIPTION OF THE DRAWINGS

FIG. 1 shows oblique views of an electrostatic ink-jet recording head of the present invention;

FIG. 2 shows sectional views of the electrostatic ink-jet recording head illustrated in FIG. 1;

DESCRIPTION OF THE PREFERRED EMBODIMENTS

Below, an embodiment of an electrostatic ink-jet recording head according to the present invention is described in detail with reference to the drawings.

Figure 1A:
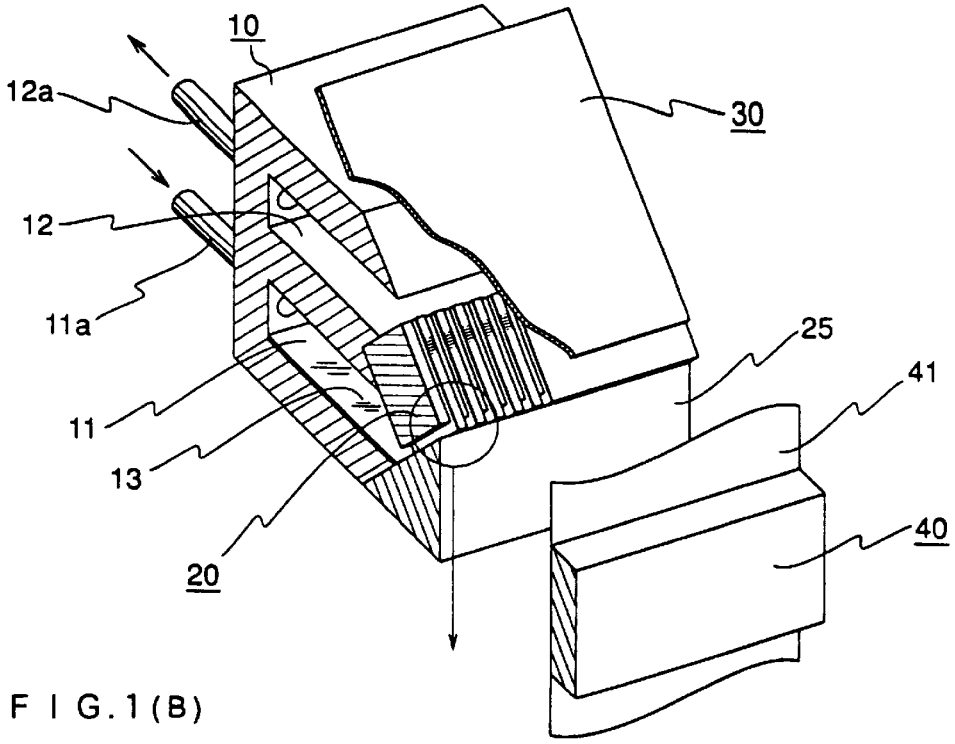
FIG. 1(A) shows a general oblique view.
Figure 1B:
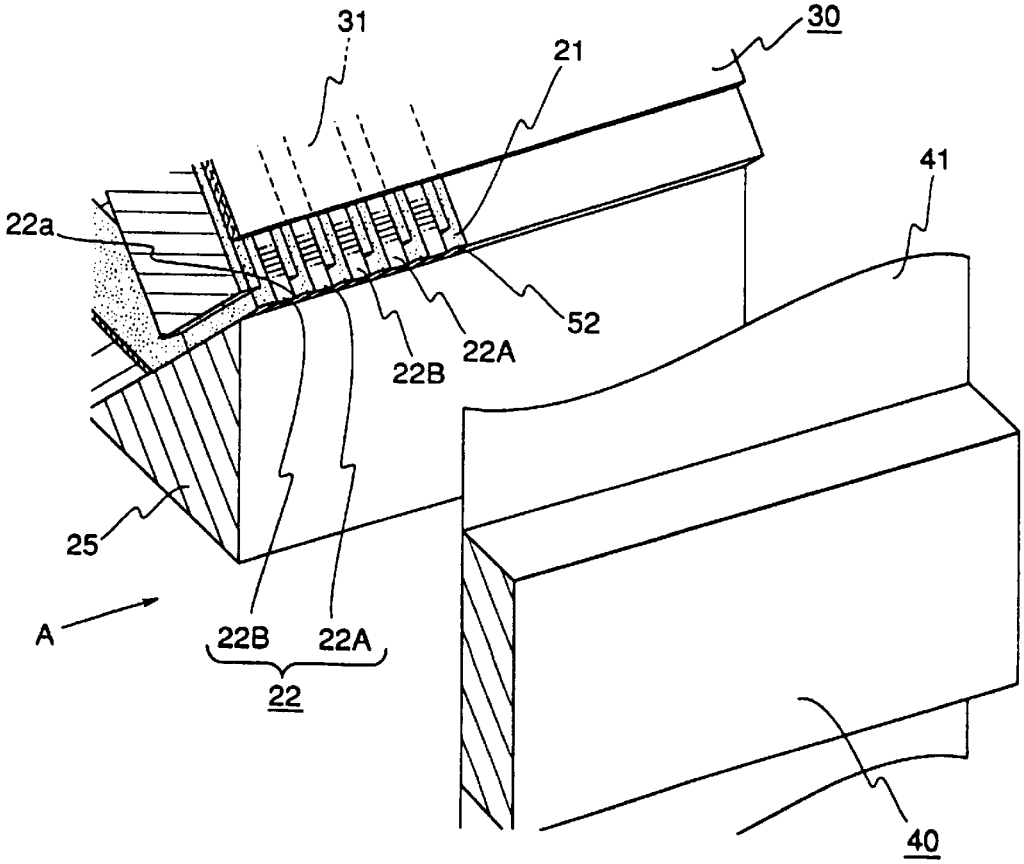
FIG. 1(B) shows an enlarged partial oblique view.

FIG. 1 comprises a sectional oblique view of an electrostatic ink-jet recording head (FIG. 1(A)) and a sectional oblique view showing an enlarged portion thereof (FIG. 1(B)). In FIG. 1, the electrostatic ink-jet recording head according to the present mode of implementation comprises the following principal constituent parts. Namely, a quadrilateral ink discharge member 20 formed from an insulating material of ceramic, polymer material, or the like, is supported on a head block 10. The electrostatic ink-jet recording head also comprises a substrate 30, which is constituted by an insulating thin plate or polymer film, or the like. A plurality of independent recording electrodes 31 are formed in a mutually parallel pattern on the surface of the substrate 30. An opposing electrode 40 which supports the recording paper 41 from behind during printing is placed in a position opposing the substrate 30 (forward position in FIG. 1). This opposing electrode 40 is made from a conductive material, such as metal, etc. and is connected to an earth (GND) or external power supply (not illustrated). Each component is described in detail below.

Firstly, the head block 10 is provided with an ink supply chamber 11 which supplies ink 50 (described later) and an ink drain chamber 12 which drains the ink externally. A supply pipe 11*a* for supplying ink 50 from an external source is connected to the ink supply chamber 11. The ink drain chamber 12 is provided with a drain pipe 12*a*, and the ink 50 can be drained externally by means of this drain pipe 12*a*. The head block is formed with an approximately E-shaped section, as shown in FIG. 2(B).

The ink supply chamber 11 and the ink drain chamber 12 are connected by means of the ink discharge member 20, which is described later. Therefore, by supplying ink to the ink supply chamber 11 and draining ink 50 from the ink drain chamber 12, the ink 50 is recycled between the head and an external ink tank (not illustrated). It can be expected that air bubbles will become mixed into the ink 50 in the ink discharge member 20 during recycling of the ink 50. Since air bubbles have a detrimental effect on recording quality, they need to be suppressed. Therefore, desirably, the ink drain chamber 12 is positioned above the ink supply chamber 11 in order to prevent residual air bubbles in the head block 10. However, this is not an essential element of the present invention.

A migration electrode 13 made from a conductive material, such as metal, is provided inside the ink supply chamber 11. This migration electrode 13 is connected to an external power supply (not illustrated), and it is in direct contact with the ink 50 contained in the ink supply chamber 11.

A fixed bias voltage of the same polarity as the charged toner particles 50*a* is applied to this migration electrode 13. An earth (GND) level or a fixed bias voltage of different polarity to the charged toner particles 50*a* is applied constantly to the opposing electrode 40.

Figure 2A:
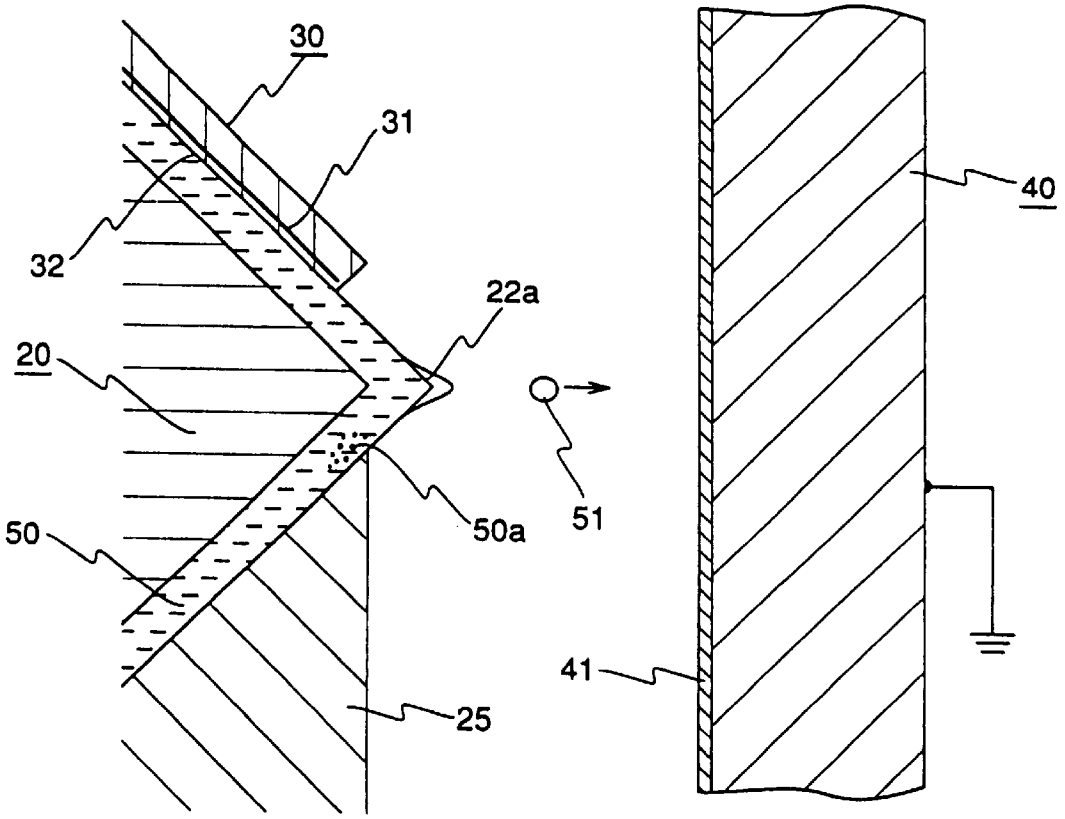
FIG. 2(A) is a sectional view showing the vicinity of an ink discharge end section.
Figure 2B:
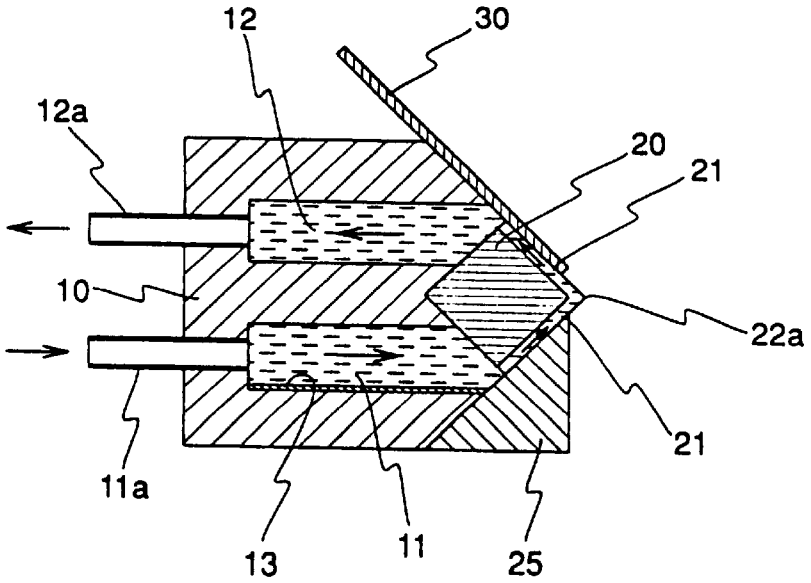
FIG. 2(B) is a sectional view showing the whole recording head.

FIG. 2 is an enlarged sectional oblique view of the ink discharge end section 22*a* of the ink discharge member 20 in the electrostatic ink-jet recording head shown in FIG. 1. As FIG. 2 shows, the ink discharge member 20 has two oblique faces: an upper face and a lower face, and the portion where the upper and lower faces intersect forms an ink discharge end section 22*a* which emits ink. A plurality of ink recycling grooves 21 are formed running along the upper face and the lower face such that they pass through the ink discharge end section 22*a*. The spaces between adjacent ink discharge grooves 21 form ink discharge step sections 22 having a convex sectional shape (see FIG. 1(B)), and the ink discharge grooves 21 and ink discharge step sections 22 are formed such that they are mutually connected.

In other words, one corner of the ink discharge member 20 is formed as an ink discharge end section, and at this ink discharge end section 22*a*, the ink discharge grooves 21 and the ink discharge step section 22 form an angled structure. This angled ink discharge end section projects towards an opposing electrode 40 which supports the recording paper 41 from behind. This projecting region forms a point which discharges ink. By means of this composition, the quadrilateral ink discharge member 20 is supported by the head block 10.

As shown in FIG. 1(B), the ink discharge step sections 22 are positioned at a pitch equivalent to half the dot pitch at the maximum desired resolution. Furthermore, the recording electrodes 31 are arranged at a pitch corresponding to the desired resolution. Therefore, the recording electrodes 31 are arranged at a ratio of one to every two ink discharge step sections 22. The respective central longitudinal axes of every other ink discharge step section 22 and the corresponding recording electrode 31 coincide with each other. The recording electrodes 31 are formed with a width greater than that of the corresponding ink discharge step sections 22. Desirably, the width of each ink discharge step section 22 is 20 $\mu$m or less.

In this mode of implementation, of the ink discharge step sections 22, only every other ink discharge step section 22A corresponding to a recording electrode 31 functions as a point which actually discharges ink droplets (indicated by symbol 51) at its ink discharge end section 22*a*. The other ink discharge step sections 22B function as partitions between the ink discharge step sections 22A. In other words, after an ink droplet 51 has been discharged from the ink discharge end section 22*a* of an ink discharge step section 22A, the ink discharge step sections 22B function as partitions which prevent vibrations in the meniscus from being transmitted to the discharge end section 22*a*.

As described above, in the ink discharge member 20, the ink recycling grooves 21 and the ink discharge step sections 22 are formed on the intersecting upper and lower oblique faces. It is necessary to form a recycling path for the ink 50 which connects to the ink discharge grooves 21. Therefore, as shown in FIG. 2, on the upper oblique face, the substrate 30 is placed against the ink discharge grooves 21 and the ink discharge step sections 22. Meanwhile, the lower oblique face is covered by a covering member 25, in order to prevent ink 50 flowing out from the ink discharge grooves 21 and ink discharge step sections 22. The covering member 25 is positioned several 10 $\mu$m behind the ink discharge end sections 22*a* of the ink discharge member 20. Furthermore, the substrate 30 is positioned behind the ink discharge end sections 22*a* of the ink discharge member 20. Consequently, a state is achieved wherein the ink discharge end sections 22*a* are exposed externally from the end of the substrate 30 on the upper side of the ink discharge member 20.

The opposing electrode 40 is positioned at an interval such that a prescribed printing gap can be ensured between the recording paper 41 the ink discharge end sections 22*a* of the ink discharge member 20. The opposing electrode 40 also serves the function of a platen for conveying the recording paper 41. The recording paper 41 supplied by a paper supply mechanism (not illustrated) is conveyed into the printing gap between the opposing electrode 40 and the ink discharge end section 22*a* such that it is always in contact with the opposing electrode.

As described above, the recording electrodes 31 are patterned onto the substrate 30. More specifically, they are formed parallel to the ink discharge grooves 21 and ink discharge step sections 22 and are aligned at intervals equal to the dot pitch in the required resolution. Electrode pads for connecting to an external driver power source, which is not illustrated, are formed at the other ends of the recording electrodes 31. In the substrate 30, the recording electrodes 31 are positioned several 10 $\mu$m behind the ink discharge end sections 22*a* of the ink discharge member 20. By means of the compositions described above, the electrostatic ink-jet recording head according to the present mode of implementation has the following operation and action.

Figure 3:
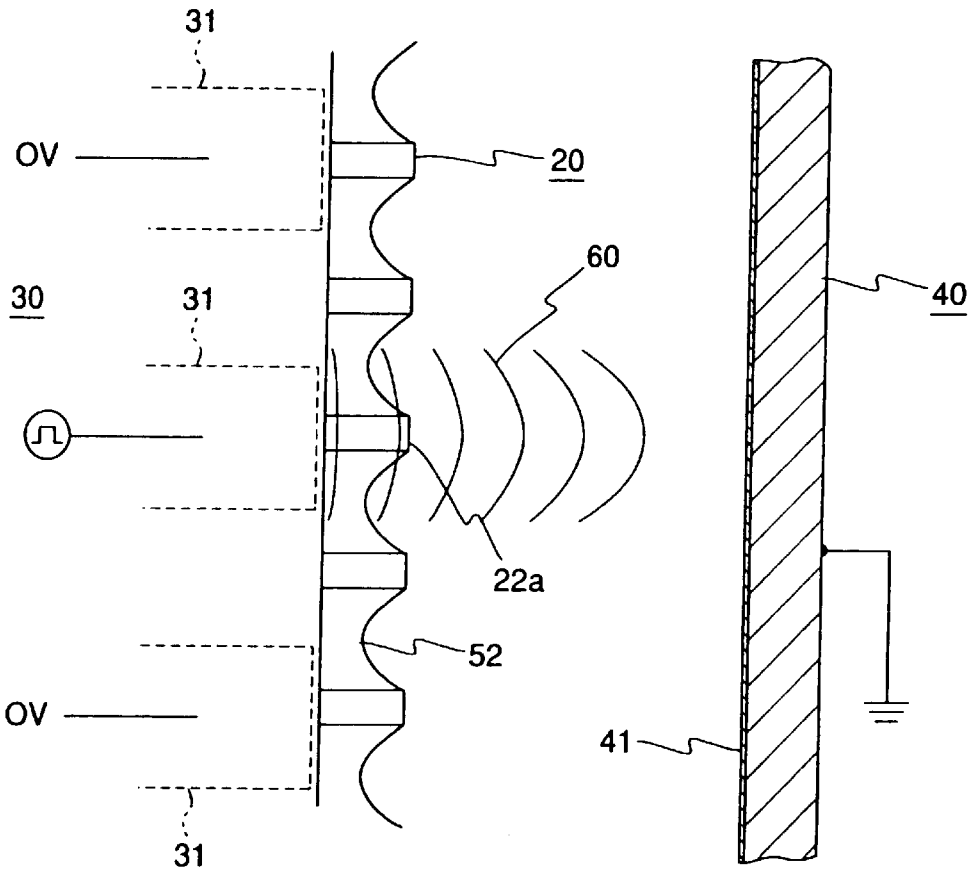
FIG. 3 shows a plan view of an electrostatic ink-jet recording head according to the present invention, and more particularly, a plan view of an electrostatic ink-jet recording head giving a schematic illustration of equipotential lines generated in the vicinity of the ink discharge end sections.
Figure 4:
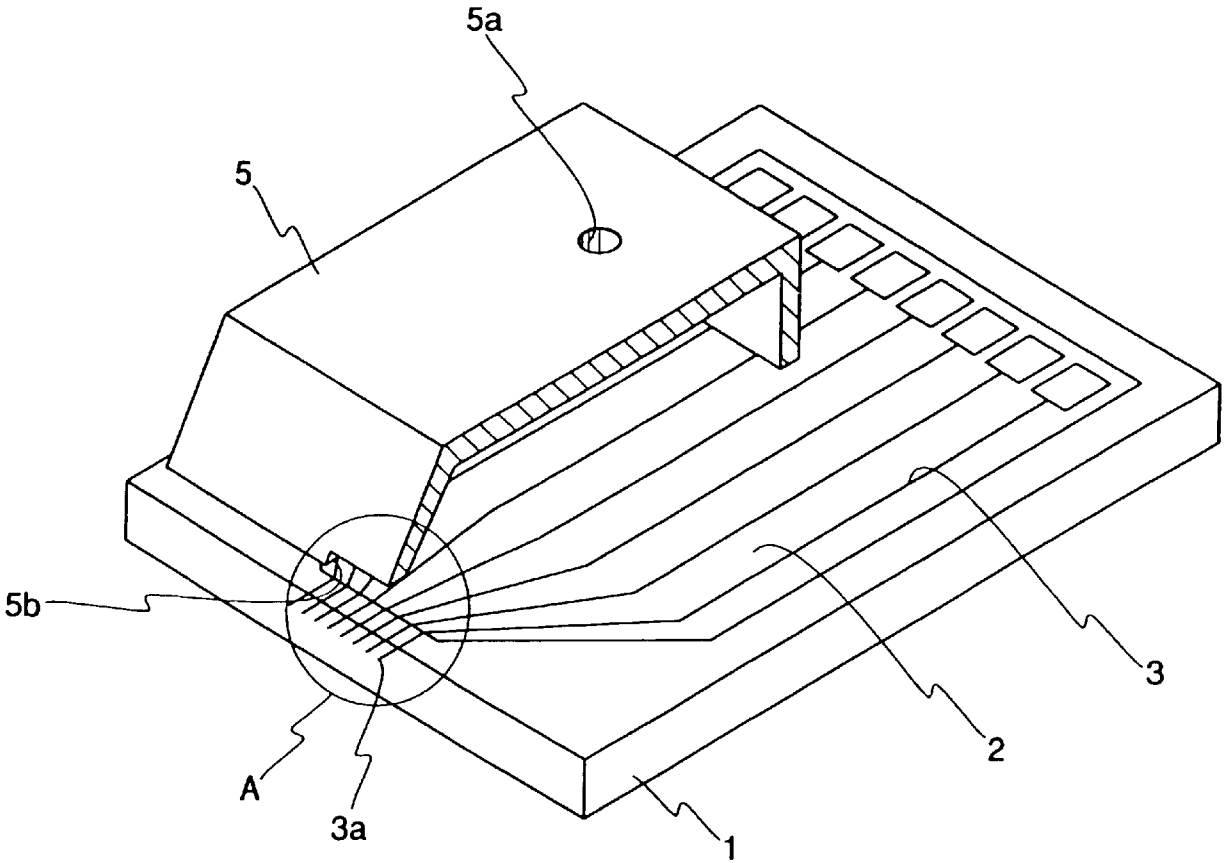
FIG. 4 is an oblique view showing a conventional electrostatic ink-jet recording head.
Figure 5:
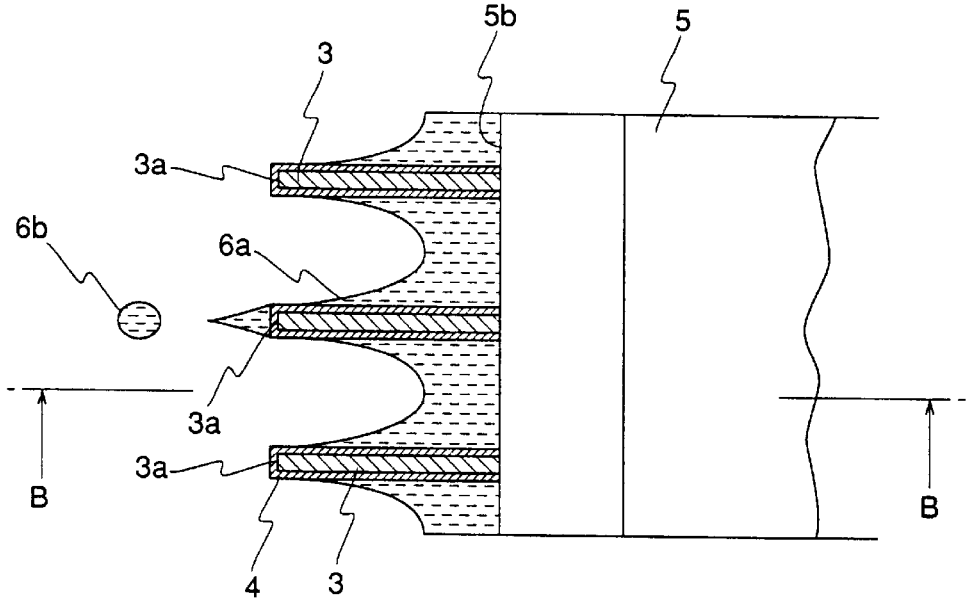
FIG. 5 is a plan view of an electrostatic ink-jet recording head.
Figure 6:
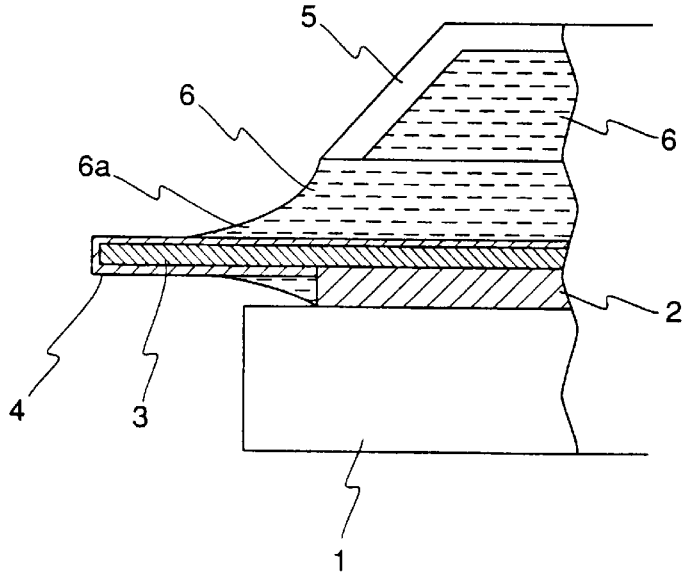
FIG. 6 is a sectional side view along line B—B in FIG. 5.
Figure 7:
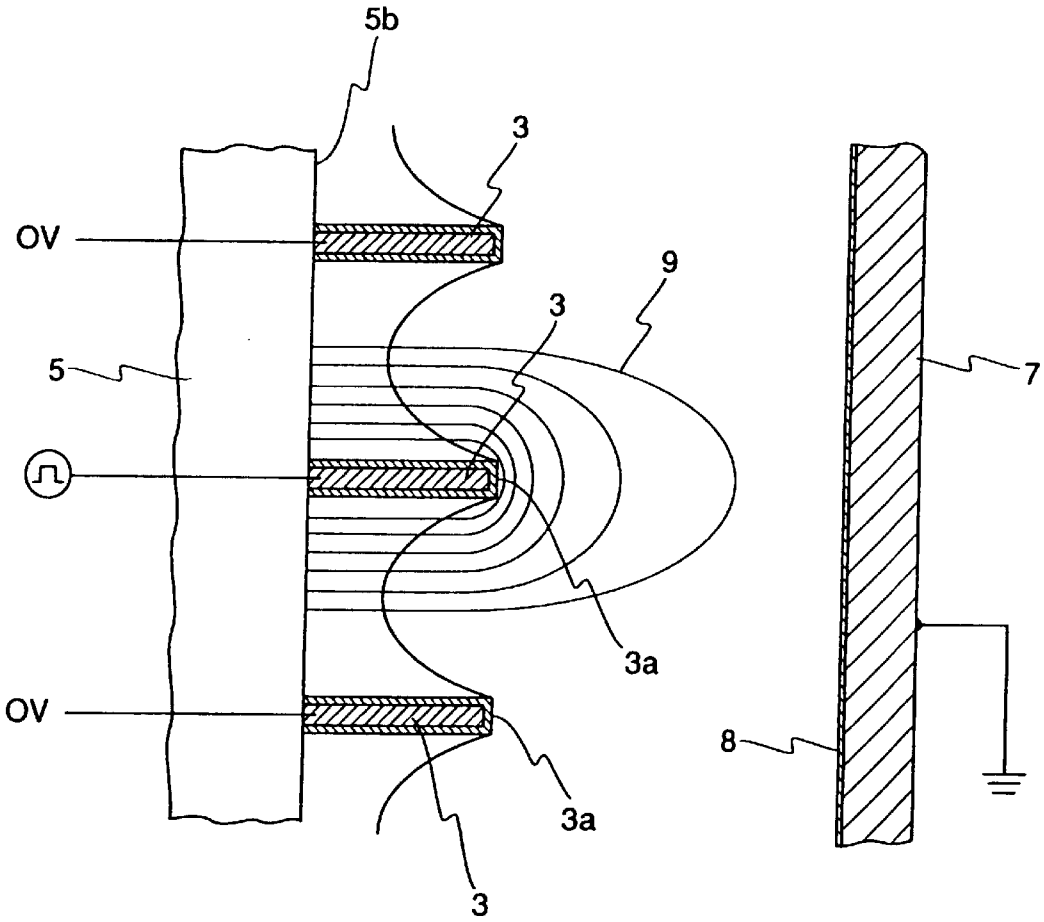
FIG. 7 is a plan view of the electrostatic ink-jet recording head shown in FIG. 4, giving a schematic illustration of the equipotential lines generated in the vicinity of the recording electrodes during recording.

A prescribed back pressure is applied to the ink 50 recycled from the ink supply chamber 11 to the ink drain chamber 12 in the head block 10. This back pressure is of a level such that it does not exceed the capillary action of the ink 50 in the ink discharge grooves 21. Therefore, as shown in FIG. 3, a convex meniscus 52 having vertices at each ink discharge end section 22*a* is formed in the region of the ink discharge end sections 22*a* of the ink discharge member 20.

A constant bias voltage of the same polarity as the charged toner particles 50*a* is applied to the migration electrode 13 in the ink supply chamber 11, and an earth level or a constant bias voltage of different polarity to the charged toner particles 50*a* is applied constantly to the opposing electrode 40.

Toner particles 50*a* are dispersed in the ink 50 introduced into the ink supply chamber 11 in the head block 10. The toner particles 50*a* are drawn towards the opposing electrode by means of the migration electrode 13 which is in contact with the ink 50. In this case, the voltage of the migration electrode 13 is of a level whereby the ink is not discharged from the discharge end section 22*a*. Therefore, the ink 50 is supplied to the ink discharge end sections 22*a* in the ink discharge member 20.

During recording, a drive pulse voltage is applied to a desired recording electrode 31 by the driver, and an electrostatic force acts on the toner particles 50*a* in the ink 50 supplied to the ink discharge end section 22*a*, due to the electric field generated between the recording electrode 31 and the opposing electrode 40. The electrostatic force applied to the toner particles 50*a* exceeds the surface tension of the ink meniscus at the discharge end section 22*a*, thereby causing an ink droplet 51 containing toner particles 50*a* to be discharged from the ink discharge end section 22*a* towards the opposing electrode 40. The ink droplet 51 adheres to recording paper 41 of the opposing electrode 40, thereby conducting a recording operation by printing.

The equipotential lines 60 generated during recording are shown in FIG. 3. In this case, the equipotential lines 60 in the vicinity of the ink discharge end section 22*a* when a recording voltage is applied are virtually perpendicular to the direction in which the ink is discharged. This is because the recording electrodes 31 are positioned slightly behind the ink discharge end sections 22*a* of the ink discharge member 20. An electrostatic force is generated drawing the toner particles in the vicinity of the ink discharge end section 22*a* towards the ink discharge end section 22*a*. Therefore, the supply of toner particles 50*a* to the ink discharge end section 22*a* will be continuous even when the recording voltage is applied.

As described above, in the electrostatic ink-jet recording head according to the present embodiment, a concave-shaped ink meniscus 52 is formed in front of the recording electrodes 31. Consequently, even when a recording voltage is applied, toner particles 50*a* gather at the discharge end section 22*a*, and thus a sufficient quantity of toner particles 50*a* for forming the desired dot size can be supplied.

Furthermore, by changing the time period for which the recording voltage is applied to the recording electrodes, it is possible to vary the quantity of toner particles 50*a* supplied to the ink discharge end section 22*a*. Therefore, the desired dot size can be formed.

Moreover, since every other ink discharge step section 22B functions as an isolating partition between the ink discharge step sections 22A which actually discharge ink, vibrations in the ink meniscus in the region of the ink discharge end section 22*a* after discharge of the ink do not affect the ink meniscus at the discharge end section 22*a* of the ink discharge step sections 22A. Consequently, it is possible to obtain a stable ink meniscus at all times.

Furthermore, since a compulsory flow of ink from the ink supply chamber 11 to the ink drain chamber 12 is generated inside the ink discharge grooves 21 formed in the vicinity of the ink discharge end sections 22*a*, the ink 50 is recycled smoothly in the ink discharge grooves 21. Therefore, it is possible to prevent accumulation of the toner particles 50*a* in the vicinity of the ink discharge end section 22*a* nearest to the opposing electrode 40. Consequently, it is possible to prevent ink droplet discharge faults due to excessive accumulation of toner particles 50*a*. In the electrostatic ink-jet recording head according to the present invention, a TAB tape based on TAB (Tape Automated Bonding) mounting technology, for example, is used when forming the recording electrodes 31. Specifically, the recording electrodes 31 are formed integrally onto a base film made from this TAB tape. The process of coating the recording electrodes 31 can be carried out by coating on an insulating coating material 32 consisting of perylene resin.

As described above, in the electrostatic ink-jet recording head according to the present invention, since the ink discharge end sections are formed in front of the recording electrodes and the recording electrodes are formed such that they surround the ink discharge end sections, it is possible to supply to the discharge points a sufficient quantity of toner particles for forming desired dots, by generating a reservoir of ink by means of an ink meniscus in front of the recording electrodes.

The invention may be embodied in other specific forms without departing from the spirit or essential characteristic thereof. The present embodiments is therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 9-086229 (Filed on Apr. 4, 1997) including specification, claims, drawings and summary are incorporated herein by reference in its entirety.

What is claimed is:

1. An electrostatic ink-jet recording head comprising:

(a) recording electrodes extending in a longitudinal direction toward respective end portions of the recording electrodes for ejecting ink towards recording paper;

(b) an opposing electrode for generating a prescribed electric field between the recording electrodes and the opposing electrode; and (c) ink discharge end sections, separate from said recording electrodes, formed in a vicinity of the recording electrodes and formed of a material different than said recording electrodes, wherein said ink discharge end sections are formed in a position closer to the opposing electrode than the end portions of the recording electrodes.

2. The electrostatic ink-jet recording head according to claim 1, wherein the width of the recording electrodes is greater than that of the ink discharge end sections.

3. The electrostatic ink-jet recording head according to claim 1, wherein the surface of the recording electrodes is covered with a film of insulating coating material.

4. The electrostatic ink-jet recording head according to claim 1, wherein the ink discharge end sections are formed from an insulating material having a dielectric constant of 10 or less.

5. An electrostatic ink-jet recording head comprising:

(a) a head block holding ink;

an ink supply chamber for supplying ink from an external source and an ink drain chamber for draining ink externally are formed;

(b) ink discharge end sections formed in a path from the ink supply chamber to the ink drain chamber;

(c) ink recycling grooves formed from the ink supply chamber to the ink discharge end sections and from the ink discharge end sections to the ink drain chamber;

(d) recording electrodes for ejecting ink, positioned in the vicinity of ink discharge end sections; and (e) an opposing electrode for creating an electric field between the recording electrodes and the opposing electrode, said recording electrodes being formed of a material different than said ink discharge end sections, said recording electrodes including end portions located closer to said opposing electrode than other portions of said recording electrodes, wherein said ink discharge end sections are formed in a position closer to the opposing electrode than the end portions of the recording electrodes.

6. The electrostatic ink-jet recording head according to claim 5, wherein the width of the recording electrodes is greater than that of the ink discharge end sections.

7. The electrostatic ink-jet recording head according to claim 5, wherein the surface of the recording electrodes is covered with a film of insulating coating material.

8. The electrostatic ink-jet recording head according to claim 5, wherein the ink discharge end sections are formed from an insulating material having a dielectric constant of 10 or less.

9. The electrostatic ink-jet recording head according to claim 5, wherein the ink discharge end sections are formed by two intersecting oblique faces.

10. The electrostatic ink-jet recording head according to claim 9, wherein the width of the recording electrodes is greater than the width of the ink discharge end sections.

11. The electrostatic ink-jet recording head according to claim 9, wherein the surface of the recording electrodes is covered with a film of insulating coating material.

12. The electrostatic ink-jet recording head according to claim 9, wherein the ink discharge end sections are formed from an insulating material having a dielectric constant of 10 or less.

13. The electrostatic ink-jet recording head according to claim 9, wherein:

(a) the ink recycling grooves are formed on both of the intersecting oblique faces;

(b) a prescribed substrate is positioned on one of the oblique surfaces such that it covers the ink recycling grooves; and the recording electrodes are formed by patterning onto the substrate, these recording electrodes being positioned such that they confront the ink recycling grooves; and (c) a prescribed covering member is provided on the other oblique surface, such that it covers the ink recycling grooves.

14. The electrostatic ink-jet recording head according to claim 13, wherein the width of the recording electrodes is greater than that of the ink discharge end sections.

15. The electrostatic ink-jet recording head according to claim 13, wherein the surface of the recording electrodes is covered with a film of insulating coating material.

16. The electrostatic ink-jet recording head according to claim 13, wherein the ink discharge end sections are formed from an insulating material having a dielectric constant of 10 or less.

17. The electrostatic ink-jet recording head according to claim 13, wherein the recording electrodes are provided at a pitch of one for every other ink discharge end section, and the longitudinal central axes of the recording electrodes and the ink discharge end sections coincide with each other.

18. The electrostatic ink-jet recording head according to claim 17, wherein a plurality of recording electrodes, ink recycling grooves and ink discharge end sections are arranged in parallel to the opposing electrode, and prescribed partitions are provided between the ink discharge end sections where the recording electrodes are provided.

19. The electrostatic ink-jet recording head according to claim 17, wherein the surface of the recording electrodes is covered with a film of insulating coating material.

20. The electrostatic ink-jet recording head according to claim 17, wherein the ink discharge end sections are formed from an insulating material having a dielectric constant of 10 or less.

21. The electrostatic ink-jet recording head according to claim 5, wherein (a) a migration electrode in contact with the ink is provided in the ink supply chamber; and (b) a voltage of the same polarity of toner is supplied to the migration electrode.

22. An electrostatic ink-jet recording head comprising:

a head block holding ink;

an ink supply chamber for supplying ink from an external source and an ink drain chamber for draining ink externally;

ink discharge end sections formed in a path from the ink supply chamber to the ink drain chamber;

ink recycling grooves formed from the ink supply chamber to the ink discharge end sections and from the ink discharge end sections to the ink drain chamber;

recording electrodes for ejecting ink, positioned in the vicinity of ink discharge end sections; and an opposing electrode for creating an electric field between the recording electrodes and the opposing electrode, said recording electrodes including end portions located closer to said opposing electrode than other portions of said recording electrodes, wherein said ink discharge end sections are formed in a position closer to the opposing electrode than the end portions of the recording electrodes;

wherein the ink discharge end sections are formed by two intersecting oblique faces, and wherein the ink recycling grooves are formed on both of the intersecting oblique faces, a prescribed substrate is positioned on one of the oblique surfaces such that it covers the ink recycling grooves and the recording electrodes are formed by patterning onto the substrate, the recording electrodes being positioned such that they confront the ink recycling grooves and a prescribed covering member is provided on the other oblique surface such that it covers the ink recycling grooves.

23. The electrostatic ink-jet recording head according to claim 22, wherein the width of the recording electrodes is greater than that of the ink discharge end sections.

24. The electrostatic ink-jet recording head according to claim 22, wherein the surface of the recording electrodes is covered with a film of insulating coating material.

25. The electrostatic ink-jet recording head according to claim 22, wherein the ink discharge end sections are formed from an insulating material having a dielectric constant of 10 or less.

26. The electrostatic ink-jet recording head according to claim 22, wherein the recording electrodes are provided at a pitch of one for every other ink discharge end section, and the longitudinal central axes of the recording electrodes and the ink discharge end sections coincide with each other.

27. The electrostatic ink-jet recording head according to claim 26, wherein a plurality of recording electrodes, ink recycling grooves and ink discharge end sections are arranged in parallel to the opposing electrode, and prescribed partitions are provided between the ink discharge end sections where the recording electrodes are provided.

28. The electrostatic ink-jet recording head according to claim 26, wherein the surface of the recording electrodes is covered with a film of insulating coating material.

29. The electrostatic ink-jet recording head according to claim 26, wherein the ink discharge end sections are formed from an insulating material having a dielectric constant of 10 or less.

30. The electrostatic ink-jet recording head according to claim 22, wherein a migration electrode in contact with the ink is provided in the ink supply chamber and a voltage of the same polarity of toner is supplied to the migration electrode.

* * * * *